US006030516A

United States Patent [19]

O'Driscoll

[11] Patent Number: 6,030,516

[45] Date of Patent: Feb. 29, 2000

[54] TIN PLATING ELECTROLYTE COMPOSITIONS

[76] Inventor: Cavan Hugh O'Driscoll, 61 East View, Barlby Road, Selby, North Yorkshire,Y08 7BA, United Kingdom

[21] Appl. No.: 09/051,833

[22] PCT Filed: Oct. 15, 1996

[86] PCT No.: PCT/GB96/02522

§ 371 Date: Jul. 2, 1998

§ 102(e) Date: Jul. 2, 1998

[87] PCT Pub. No.: WO97/14826

PCT Pub. Date: Apr. 24, 1997

[30] Foreign Application Priority Data

Oct. 17, 1995 [GB] United Kingdom ..... 9521192
Nov. 6, 1995 [GB] United Kingdom ..... 9522693

[51] Int. Cl.[7] ..... C25D 3/32

[52] U.S. Cl. ..... 205/302; 205/254; 106/1.25

[58] Field of Search ..... 205/302, 303, 205/304, 254; 106/1.25

[56] References Cited

U.S. PATENT DOCUMENTS 5,258,112 11/1993 Wild et al. ..... 205/302

FOREIGN PATENT DOCUMENTS 19 11 626 10/1969 France .
592 442 9/1947 United Kingdom .

*Primary Examiner*—Kishor Mayekar
*Attorney, Agent, or Firm*—Morrison & Foerster

[57] ABSTRACT

There is disclosed a composition suitable for use in a process for electroplating surfaces with tin, comprising: an unsubstituted or substituted para alkylbenzene sulphonic acid (component a), one or more acids capable of giving good plating at low current density (component b), one or more addition agents, a tin source, water. There are also described methods of tin plating by the compositions of the invention.

17 Claims, No Drawings

TIN PLATING ELECTROLYTE COMPOSITIONS

This application is a 35 U.S.C. 371 National stage filing of International Application PCT/GB96/02522 filed Oct. 15, 1996.

This invention relates to electrolyte compositions suitable for electroplating surfaces with tin and to methods of electroplating surfaces with tin. The invention is particularly suitable for use in high speed strip or wire plating.

Ideally an electrolyte should posses the following properties:- produce a wide plating range, give a good quality deposit, have low corrosivity, have good conductivity, have good antioxidant properties, have low toxicity and have low environmental impact.

Many electrolyte compositions have been made known and are available in the art. Typical baths include aqueous acidic baths based upon fluoroborate and fluorosilicate electrolytes as described, for example, in U.S. Pat. No. 3,769,182 and U.S. Pat. No. 4,118,289. Aryl sulphonic acids have been used in electroplating baths as disclosed, for example, in U.S. Pat. No. 3,905,878 . Traditionally, the aryl sulphonic acid of choice is phenolsulphonic acid as used in the Ferrostan process. The use of toluenesulphonic acid in electroplating baths has also been specifically described, for example in U.S. Pat. No. 2,271,209.

Mineral acid (especially sulphuric acid) electroplating baths have also been described. For example, U.S. Pat. No. 2,156,427 describes a bath containing tar acids and sulphuric acid for producing tin coatings of a fine crystalline texture.

Alkane sulphonic acids containing 1 to 5 carbon atoms in the alkyl group have previously been used in certain electrolytic plating baths and were first disclosed for this use in U.S. Pat. No. 2,522,942. More recently, methane sulphonic acid has been claimed as a specific preferred example of an alkane sulphonic acid in combination with a number of brightening agents for use in the electroplating of tin, lead and tin-lead alloys for example as in U.S. Pat. No. 4,565,610 and U.S. Pat. No. 4,617,097. Systems based on methane sulphonic acid however suffer from high cost, toxicity, odour problems and have been known to introduce surface defects on flow brightened strip steel plate.

Various plating bath compositions comprising an alkane or alkanol sulphonic acid (normally methane sulphonic acid), a tin and/or a lead salt and various auxiliary additives are known. Known auxiliary additives range from smaller organic molecules to large polymeric surfactant molecules and are described in U.S. Pat. Nos. 4,555,314, 4,565,609, 4,582,576, 4,599,149, 4,617,097, 4,666,999, 4,673,470, 4,701,244, 4,828,657 and U.S. Pat. No. 4,849,059.

Plating bath compositions containing mixtures of aryl and alkyl sulphonic acids are also known in the art, for example, as described in EP 0 490 575.

Various addition agents have been proposed which enhance the quality of the tin plate. They can include condensates of hydrophobic organic compounds with alkylene oxides such as, for example, alpha naphthol 6 mol ethoxylate ("ENSA 6" as supplied by Emery-Trylon); alkylbenzene alkoxylates such as the 'Tritons'; derivatives of N-heterocycles such as, for example, 2-alkylimidazolines; aromatic aldehydes such as naphthaldehyde; derivatives of 2,2-bis(4-hydroxyphenyl)propane, for example, as "Diphone V" (as supplied by Yorkshire Chemicals) formed by reacting 2,2-bis(4-hydroxyphenyl)propane with a sulphonating agent; and 2,4,6-substituted phenols in which at least one of the substituents includes a secondary, tertiary or quaternary nitrogen atom as described in U.S. Pat. No. 3,954,573. The latter addition agents have, however only been described for use in fluoroborate tin plating systems.

It is generally accepted that it is the addition agent which has the greatest effect on tin plate quality and little work has been done on how acids affect plate quality such as plating width and brightness.

In the case of strip tinplate manufacture it is desirable from a commercial point of view to have a system capable of giving satisfactory tin deposits over as wide as possible a range of current densities to accommodate all variations in speed of production and minimise the incidence of current density defects.

We have unexpectedly found that certain acids have a beneficial effect on the efficiency of the addition agents. Certain acids are capable of improving the addition agents performance at high current density whilst other acids are able to improve performance at low current density. When combined, synergistic effects are produced which give even wider plating ranges and bright plates, this synergistic effect is further enhanced when the acid combination is used in conjunction with specific additives. The electrolyte compositions of the present invention also have the advantage that lead salts are much less soluble therein, than in prior art electrolytes.

Accordingly this invention provides a composition suitable for use in a process for electroplating surfaces with tin, which exhibits all the aforementioned benefits in wide plating range, good quality deposits and enhanced environmental benefits. It comprises:- a) An unsubstituted or substituted para alkyl benzenesulphonic acid. (component a)

b) One or both of sulphuric acid and sulphamic acid (component b)

c) One or more addition agents d) A tin source e) An antioxidant (optional)

f) Water.

Preferably the tin source is a tin salt. Alternatively the tin source may be elemental tin.

The para alkyl benzene sulphonic acid has the formula:-

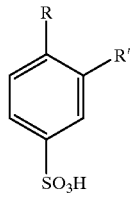

Wherein R is an alkyl group preferably containing 1–10 carbon atoms and more preferably containing 1–4 carbon atoms. R' is hydrogen or an alkyl group containing 1 to 10 carbon atoms which may be substituted, for example, by hydroxyethyl or hydroxypropyl groups.

The preferred para alkyl benzenesulphonic acid is para toluene sulphonic acid.

The acids (i.e. component a plus component b) are preferably present in a total concentration of 25–500 g/l of the composition (with respect to the composition), more preferably 30–250 g/l, even more preferably 30–100 g/l.

The preferred weight/weight ratio of component a to component b is from 90/10 to 10/90.

The tin source is preferably present in the composition at a concentration of 5–100 g/l (more preferably 15 to 60 g/l) with respect to the composition. Where a tin salt is the tin source it does not have to be a salt of the mono-substituted benzene sulphonic acid or inorganic acid. Thus the composition may contain ions other than tin, sulphonate and those from the inorganic acid. Where the tin source is solid tin, it may be as a tin anode which gradually dissolves as electrolysis proceeds to maintain a substantially constant concentration of tin ions in an electroplating bath. Where the tin source is a tin salt it may be metered to the electroplating bath so that as tin is electro-deposited from the bath, tin salt is added to the bath to maintain the concentration of tin ions in the bath at a constant level.

An antioxidant may optionally be added. These materials retard the oxidation of divalent tin to tetravalent tin which may lead to sludge formation and stannous tin loss. The preferred amount of antioxidant to be added is in the range 1 to 50 g/l of the composition and most preferably from 2.5 to 20 g/l of the composition. Typical antioxidants have been described for example in U.S. Pat. No. 3,749,649 and include 1,2,3-trihydroxybenzene, 1,2-dihydroxybenzene, 1,2-dihydroxybenzene-4-sulphonic acid, 1,2-dihydroxybenzene-3,5-disulphonic acid, 1,4-dihydroxybenzene, 1,4-dihydroxybenzene-2-sulphonic acid, 1,4-dihydroxybenzene-2,5-disulphonic acid or vanadium pentoxide.

The composition of the present invention also comprises one or more addition agents capable of enhancing the synergistic effects of mixtures of component a and component b. Although any additive known to those skilled in the art may be used, preferred additives are mono-, di- and tri-substituted phenols (each optionally alkylated or alkoxylated having at least one substituent containing at least one secondary tertiary or quaternary nitrogen atoms; or mixtures of two or more such components. The preferred phenols are 2,4- or 2,6- disubstituted or 2,4,6,-trisubstituted phenols.

Addition agents have the general formula:

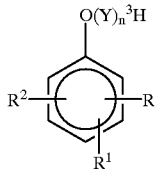

In which:-

Y=alkylene, $CH_2CH_2O$ or $CH(CH_3)CH_2O$ $n^3$=0–10

$n^3$=1 when Y=alkylene

R=a group of formula

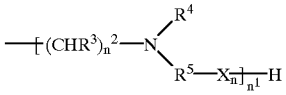

in which:-

$R^3$=H, alkyl, aryl, hydroxyl or CHO, with the proviso that when $R^3$ is hydroxyl or CHO, $n^2$=1–3, and when $R^3$ is H, alkyl or aryl, $n^2$ is 1, $R^4$=H, alkyl, cycloalkyl, hydroxyalkyl or alkoxyalkyl, $R^5$=alkyl, optionally interrupted by O or N atoms, which may be further substituted, X=a phenol (optionally alkoxylated) radical, optionally further substituted, n=0 or 1, $n^1$=1 to 7, when n=0, $n^1$=1, when n=1, $n^1$=1–7.

R may optionally be the quaternary ammonium salt formed by reaction with acids such as, sulphuric acid, toluenesulphonic acid, sulphamic acid, phenolsulphonic acid and methanesulphonic acid.

$R_1$ and $R_2$=(same or different) R, H or optionally substituted alkyl.

Especially preferable examples include compounds of the formulae:-

(a)

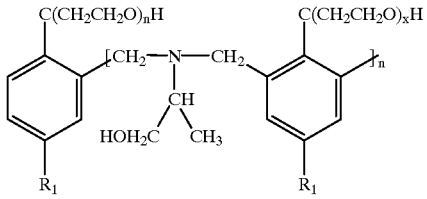

$R_1$ = $CH_3$,$CH_2CH_3CH(CH_3)_2$ or $C(CH_3)_3$; n = 1–7; x = 0–10

(b)

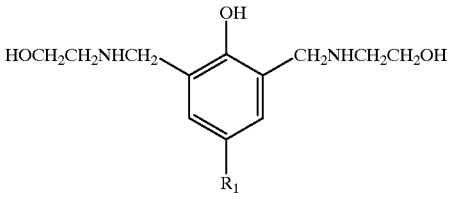

$R_1$ = $CH_3CH_2CH_3$, $CH(CH_3)_2$, or $C(CH_3)_3$ (c)

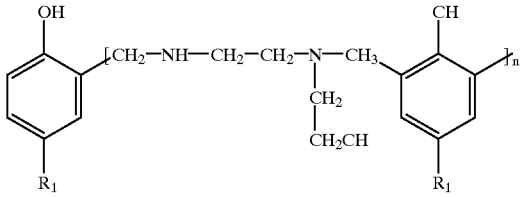

$R_1$ = $CH_3$, $CH_2CH_3$, $CH(CH_3)_2$ or $C(CH_3)_3$; n = 1–7 and

-continued (d)

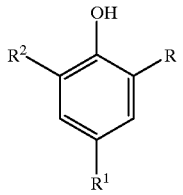

R = —$CH_2NHCH_2CH_2NHCH_2CH_2OH$ $R^1$ = —$CH_3$, —$CH_2CH_3$ or —$C(CH_3)$;

$R^2$ = H or R.

As well be known to those skilled in the art such additives can conveniently be made by condensation of the phenol with an aldehyde and an amine under acidic or basic conditions. The molar proportions of phenol to amine to aldehyde may be varied over a wide range, typically the range will be from 1:1:1 to 1:2:2. As will be obvious to those skilled in the art such reaction will give rise to a mixture of monomeric and polymeric products. The reaction products may be alkoxylated with either ethylene or propylene oxide.

Although any phenol, amine and aldehyde may be used preferred examples include:-

Phenols:- ortho and/or para alkylphenols, where the alkyl group is methyl, ethyl, isopropyl, n-butyl, sec-butyl, tert-butyl, isoamyl, hexyl, and nonyl; Diphenols:- 2,2-bis(4-hydroxyphenyl)propane or 4,4'-dihydroxydiphenylsulphone.

Aldehydes:- formaldehyde, acetaldehyde, glyoxal.

Amines:- methylamine, dimethylamine, ethylamine, diethylamine, n- or iso-propylamine, n- or sec-butylamine, n-hexylamine, ethanolamine, diethanolamine, n- or iso-propanolamine, 2-aminobutanol, 4-aminobutanol, 2-amino-5-diethylaminopentane, 2-(2-aminoethoxy)ethanol, 2-(2aminoethylamino)ethanol, 2-amino-2-ethyl-1,3-propandiol.

The composition of this aspect of the invention demonstrates the aforementioned synergistic effect with respect to compositions which contain only acids of component a or acids of component b alone. The compositions of the present invention when used for tin plating provides a wider plating range than can be obtained by using either acids of component a or acids of component b alone. The preferred acid of component a is para toluenesulphonic acid and the preferred acid of component b is sulphuric acid.

The surfaces which can be tin-plated using the compositions and methods of the invention are those surfaces which may normally be tin-plated e.g. steel or copper.

EXAMPLES

Example 1

This example illustrates how the preferred addition agents may be synthesised using base catalysis.

Substituted phenol (1 mole), water (equivalent weight based on phenol) and sodium hydroxide (0.2 mole) were charged to the reactor. The mixture was heated at 60° C. with agitation until a clear solution was obtained.

Amine (2 moles) was charged into a second reactor and formaldehyde (2 moles) slowly added with stirring whilst keeping the temperature below 60° C. This solution was added to the .alkylphenol solution in this first reactor and the mixture heated at 100° C. for half an hour.

The following examples shown in Table 1 are illustrative of this method of synthesis.

TABLE 1

| EXAMPLE NUMBER | PHENOL | AMINE |
|---|---|---|
| 2 | 4-METHYL PHENOL | ETHANOLAMINE |
| 3 | 4-TERT BUTYL PHENOL | 2-(2-AMINOETHYLAMINO) ETHANOL |
| 4 | 4, 4'-ISO-PROPYLIDENDIPHENOL | DIETHHNOLAMINE |

The electroplating characteristics of various compositions were determined in a Hull Cell at 3 amps total current for 1 minute at 45° C. A 10 cm×6 cm steel plate, pre-cleaned by immersion in sodium hydroxide followed by a water rinse and immersion in 18.5% hydrochloric acid, was used in all the following examples.

The aqueous compositions used are set out in Table 2, Examples 6, 11, 14, 16, 20 and 24 are according to the invention, whilst Examples 7, 8, 10, 12, 17, 18, 21, 22 and 23 illustrate the synergistic effect with respect to the plating range. Examples 5, 9, 15, 19 and 23 also illustrate the performance of the additives in the known phenol-4-sulphonic acid electrolyte for comparative purposes. All compositions, except the phenolsulphonic acid electrolytes of Examples 5, 9, 15, 19 and 23, included 1 g/l of antioxidant (1,2-dihydroxybenzene-4-sulphonic acid). The tin source in all cases was tin sulphate in an amount of 30 g/l calculated as $Sn^{++}$.

TABLE 2

| Example Number | PTSA (g/l) | OTSA (g/l) | Sulphuric Acid (g/l) | PSA (g/l) | Sulphamic Acid (g/l) | Addition Agent (Example No.) | Addition Agent (g/l) | Plating Range A/dm$^2$ ×10 |
|---|---|---|---|---|---|---|---|---|
| 5 | 0 | 0 | 0 | 60 | 0 | ENSA 6 | 4 | 9–54 |
| 6 | 10 | 0 | 50 | 0 | 0 | ENSA 6 | 4 | 5.5–90 |
| 7 | 0 | 0 | 60 | 0 | 0 | ENSA 6 | 4 | 5.5–85 |
| 8 | 60 | 0 | 0 | 0 | 0 | ENSA 6 | 4 | 11–37 |
| 9 | 0 | 0 | 0 | 60 | 0 | 9 parts (2) + 1 part (3) | 6 | 7–90 |
| 10 | 0 | 0 | 30 | 0 | 30 | 9 parts (2) + 1 part (3) | 6 | 20–67 |

TABLE 2-continued

| Example Number | PTSA (g/l) | OTSA (g/l) | Sulphuric Acid (g/l) | PSA (g/l) | Sulphamic Acid (g/l) | Addition Agent (Example No.) | Addition Agent (g/l) | Plating Range A/dm$^2$ ×10 |
|---|---|---|---|---|---|---|---|---|
| 11 | 10 | 0 | 0 | 0 | 50 | 9 parts (2) + 1 part (3) | 6 | 6.5–90 |
| 12 | 60 | 0 | 0 | 0 | 0 | 9 parts (2) + 1 part (3) | 6 | 11–80 |
| 13 | 50 | 10 | 0 | 0 | 0 | 9 parts (2) + 1 part (3) | 6 | 7.5–80 |
| 14 | 10 | 5 | 45 | 0 | 0 | 9 parts (2) + 1 part (3) | 6 | 5.4–90 |
| 15 | 0 | 0 | 0 | 60 | 0 | (4) | 6 | 8.3–90 |
| 16 | 10 | 0 | 50 | 0 | 0 | (4) | 6 | 5.5–100 |
| 17 | 0 | 0 | 60 | 0 | 0 | (4) | 6 | 15–67 |
| 18 | 60 | 0 | 0 | 0 | 0 | (4) | 6 | 22–54 |
| 19 | 0 | 0 | 0 | 60 | 0 | (3) | 6 | 10–90 |
| 20 | 10 | 0 | 50 | 0 | 0 | (3) | 6 | 6–93 |
| 21 | 0 | 0 | 60 | 0 | 0 | (3) | 6 | 5.4–68 |
| 22 | 60 | 0 | 0 | 0 | 0 | (3) | 6 | 20–60 |
| 23 | 0 | 0 | 0 | 0 | 50 | (2) | 6 | 7–41 |
| 24 | 25 | 0 | 0 | 0 | 25 | (2) | 6 | 7–59 |

All concentrations are in grams/liter of the composition including water.
PTSA is para toluenesulphonic acid.
OTSA is ortho toluenesulphonic acid.
PSA is phenol-4-sulphonic acid.

I claim:

1. A composition suitable for use in a process for electroplating surfaces with tin, said composition comprising:

a) an unsubstituted or substituted para alkyl benzene sulfonic acid (component a), b) sulfuric acid or sulfamic acid or both (component b), c) one ore more addition agents, d) a tin source, and e) water.

2. A composition of claim 1, wherein the tin source is a tin salt.

3. A composition of claim 1, wherein the para alkyl benzene sulphonic acid has the formula:

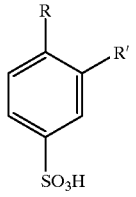

wherein R is an alkyl group containing 1–10 carbon atoms and R' is hydrogen or an alkyl group containing 1 to 10 carbon atoms optionally substituted by hydroxyethyl or hydroxypropyl groups.

4. A composition of claim 1 wherein the para alkyl benzene sulphonic acid is para toluenesulphonic acid.

5. A composition of claim 1 wherein the total acids of component a plus component b are present in a total concentration of 25–500 g/l of the composition.

6. A composition of claim 5, wherein the total acids of component a plus component b are present in a total concentration of 30–250 g/l.

7. A composition of claim 6, wherein the total acids of component a plus component b are present in a total concentration of 30–100 g/l.

8. A composition of claim 1 wherein the weight/weight ratio of component a to component b is 90/10 to 10/90.

9. A composition of claim 1 wherein the tin source is present in the composition at a concentration of 5–100 g/l of the composition.

10. A composition of claim 9, wherein the tin source is present at a concentration of 15 to 60 g/l.

11. A composition of claim 1 which also contains an antioxidant.

12. A composition of claim 11, wherein the antioxidant is 1 to 50 g/l of the composition.

13. A composition of claim 12, wherein the amount of antioxidant is 2.5 to 20 g/l of the composition.

14. A composition of claim 1 wherein the addition agents have the general formula:

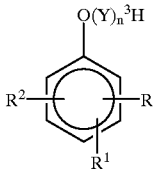

in which:

Y=alkylene, $CH_2CH_2O$ or $CH(CH_3)CH_2O$;

$n^3$=0–10;

$n^3$=1 when Y=alkylene;

R=a group of formula

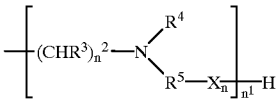

in which:

$R^3$=H, alkyl, aryl, hydroxyl or CHO, with the proviso that when $R^3$ is hydroxyl or CHO, $n^2$=1–3, and when $R^3$ is H, alkyl or aryl $n^2$ is 1, $R^4$=H, alkyl, cycloalkyl, hydroxyalkyl or alkoxyalkyl, $R^5$=alkyl, optionally interrupted by 0 or N atoms, which may be further substituted, X=a phenol (optionally alkoxylated) radical, optionally further substituted, n=0 or 1, $n^1$=1 to 7, when n=0, $n^1$=1, when n=1, $n^1$=1–7, and the quaternary ammonium salt thereof; and $R^1$ and $R^2$ may be the same or different and are R, H or optionally substituted alkyl.

15. A composition of claim 14, wherein at least one addition agent is (1)

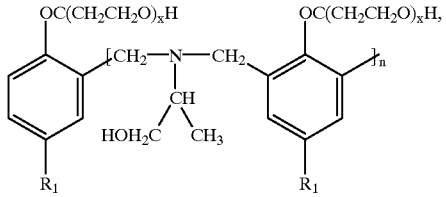

$R_1$ = $CH_3$,$CH_2CH_3CH(CH_3)_2$ or $C(CH_3)_3$; n = 1–7; x = 0–10

(2)

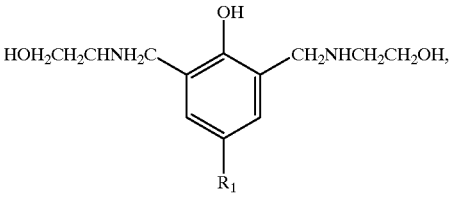

-continued (3)

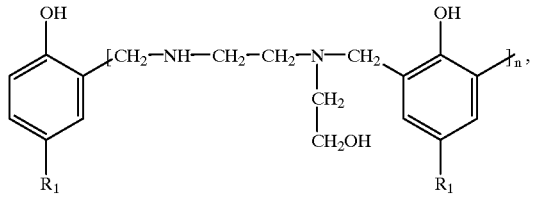

$R_1$ = $CH_3$, $CH_2CH_3$, $CH(CH_3)_2$ or $C(CH_3)_3$; n = 1–7 or (4)

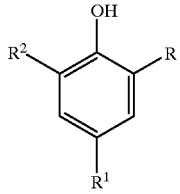

R = $—CH_2NHCH_2CH_2NHCH_2CH_2OH$ $R^1$ = $—CH_3$, $—CH_2CH_3$ or $—C(CH_3)$;

$R^2$ = H or R.

16. A method of tin plating a surface, which comprises applying to said surface the composition of claim 1.

17. A method of claim 16, wherein said applying is conducted in a strip or wire plating process.

* * * * *